US005357885A

United States Patent [19]

Yang

[11] Patent Number: 5,357,885

[45] Date of Patent: Oct. 25, 1994

[54] SHOE SEWING MACHINE

[76] Inventor: Kun-Nan Yang, No. 20, Alley 105, Lane 514, Chung Cheng Road, Hsin Chuang, Taipei Hsien, Taiwan

[21] Appl. No.: 81,134

[22] Filed: Jun. 25, 1993

[51] Int. Cl.[5] ..... D05B 15/04

[52] U.S. Cl. ..... 112/36

[58] Field of Search ..... 112/28, 34, 36, 53, 112/54; 12/13.2, 4.1

[56] References Cited

U.S. PATENT DOCUMENTS 2,202,388 5/1940 Leveque ..... 112/34
2,807,224 9/1957 Quinn ..... 112/36
2,972,316 2/1961 Ashworth et al. ..... 112/36
2,979,001 4/1961 Fitzgerald et al. ..... 112/36

*Primary Examiner*—Peter Nerbun
*Attorney, Agent, or Firm*—Bacon & Thomas

[57] ABSTRACT

A shoe sewing machine comprises a thread feed device which is capable of feeding the thread forward or withdrawing the thread, a stitching device operated at a non-uniform speed to have up-and-down motion and a shuttle rotating at a non-uniform speed, both having respective non-uniform speed controlling devices to allow the stitching device and the shuttle to cooperate with the tight-and-loose, feeding-and-withdrawing motion of the thread provided by the thread feed device to form stitching on the shoe to be sewn so that the shuttle can be disposed adjacent to the stitching device.

9 Claims, 14 Drawing Sheets

SHOE SEWING MACHINE

FIELD OF THE INVENTION

The present invention relates generally to a shoe sewing machine and in particular to a shoe sewing machine having a non-uniform speed motion in sewing operation.

BACKGROUND OF THE INVENTION

Conventionally, a shoe sewing machine comprises a rotating shuttle disposed within a head of a rocking arm which is located under the stitching device of the shoe sewing machine or the stitching device and the shuttle are disposed relative to each other in an up-and-down arrangement so that the up-and-down movement of the stitching device and the rotation of the shuttle are both moved in a uniform speed. The disadvantage of disposing the shuttle in the head of the rocking arm is that the shuttle has to move into the shoe to be sewn along with the head of the rocking arm to hook and pull out the thread. As a consequence, the size of the shuttle is thus subject to constraints. If the shuttle is large, then the movement of the shuttle into the shoe is difficult and thus affecting the stitching operation. If the shuttle is small, the spool on which the thread is wound has to be reduced in size and thus the thread that is wound on the spool has to be thinner or the overall length thereof wound on the spool is reduced. This leads to a disadvantage in that the spool has to be changed frequently during shoe sewing operation.

It is therefore desirable to provide a shoe sewing machine to overcome the deficiency associated with the disposition of the shuttle within the head of the rocking arm by disposing the shuttle adjacent the stitching device to provide the convenience of easy to change spool and the use of a large size spool which allows more thread to be wound on the spool and requires no frequent change of the spool. It is also desirable to provide a non-uniform speed sewing or stitching operation to improve the deficiency associated with the uniform speed sewing operation provided by the conventional shoe sewing machines.

SUMMARY OF THE INVENTION

According to an aspect of the present invention, there is provided a shoe sewing machine having a shuttle disposed adjacent to the stitching device thereof which provides a cyclic fast-and-slow stitching, thread pulling, thread hooking and knitting operation of sewing a shoe by the non-uniform speed motions of the stitching device and the shuttle.

According to another aspect of the present invention, there is provided a shoe sewing machine having a shuttle disposed adjacent to the stitching device so as to overcome the deficiency associated with the conventional structure wherein the shuttle is disposed within the head of a rocking arm and to provide a shoe sewing machine structure which has a greater flexibility in adjustment, easiness in changing spools, and convenience in maintenance

BRIEF DESCRIPTION OF THE DRAWINGS

Other advantages of the invention will be apparent from the following description of a preferred embodiment taken in connection with the accompanying drawings, wherein.

DETAILED DESCRIPTION OF THE PREFERRED EMBODIMENT

Figure 1:
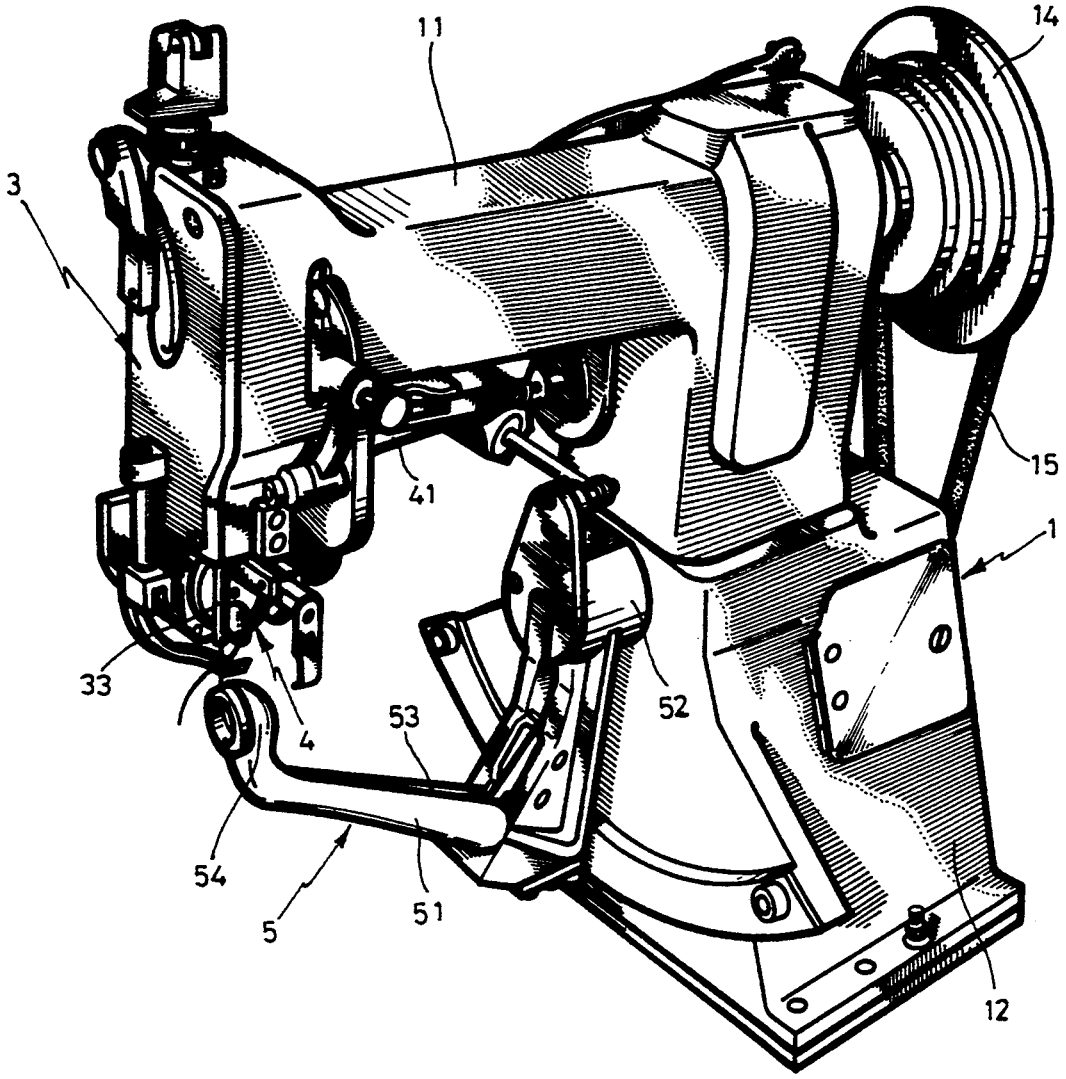
FIG. 1 is a perspective view showing a shoe sewing machine constructed in accordance with the present invention.

With reference to the drawings and in particular to FIG. 1, wherein a shoe sewing machine constructed in accordance with the present invention is shown, the shoe sewing machine comprises a housing 1 having a base 12 mounted on a base plate 20 (FIG. 2) and a hollow bridge 11 extending from the upper side thereof to overhang a rocking arm 5 extending from the base 12 to the left hand side thereof.

Figure 2:
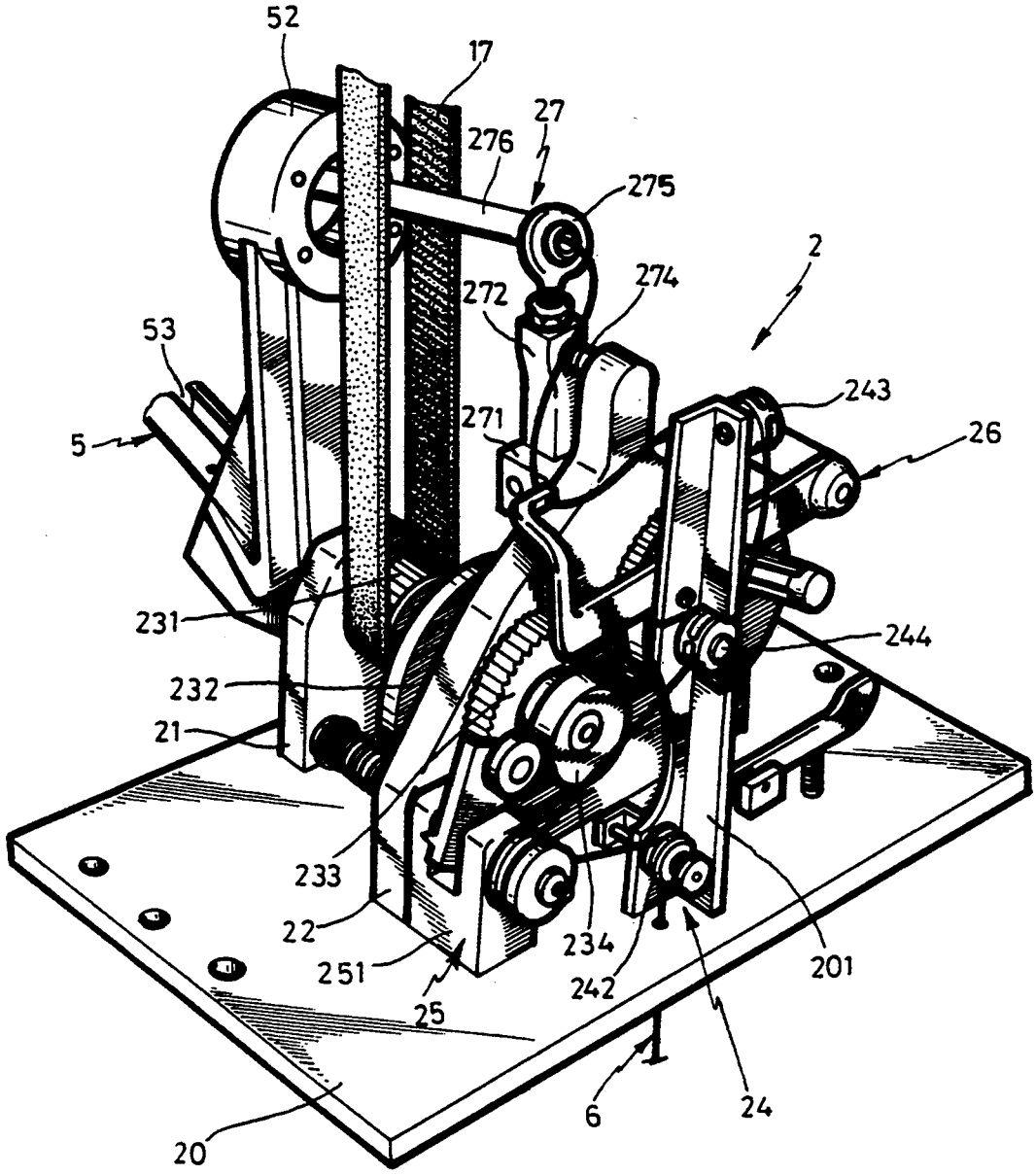
FIG. 2 is a perspective view showing the thread feed means of the shoe sewing machine of the present invention.
Figure 3:
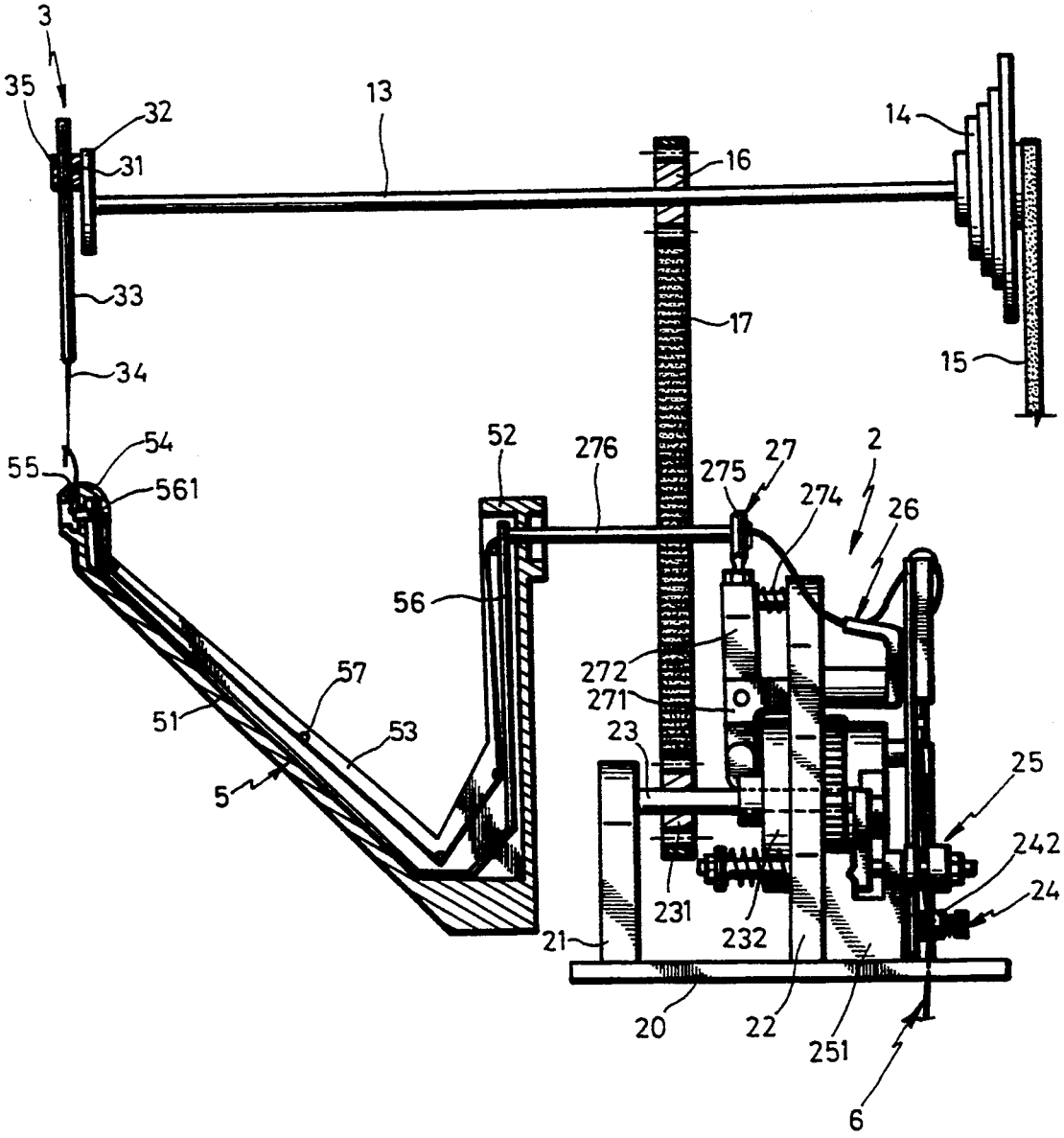
FIG. 3 is a side elevational view, partly sectioned, showing the thread feed means of the sewing machine of the present invention.

Also referring to FIGS. 2 and 3, a main driving shaft 13 is disposed inside and extending along the bridge 11 with a flywheel 14 and a belt 15 connected to an end thereof projecting out of the housing 1 from the rear side thereof for engagement with a motor (not shown) which provides mechanical power to drive the main driving shaft 15. The main driving shaft 13 transmits the mechanical power to thread feed means 2 which rests on the base plate 20 and is located under the main driving shaft 13 through a pulleybelt pair 16 and 17. The main driving shaft 13 also drives stitching means 3 located at an end thereof opposite to the flywheel 14 through a friction disk 31.

On the under side of the bridge 11, a universal joint set 41 is provided to drive thread hooking means 4 which is located under the stitching means 3 and is driven by the mechanical power transmitted from the main drive shaft 13. This will be further described hereinafter.

As shown in FIGS. 1, 2 and 3, the thread feed means 2 comprises a left bracket 21 and a right bracket 22 spaced from each other with a shaft 23 extending therebetween. The shaft 23 has a gear 231 rigidly mounted thereon to be drivingly engageable by the belt 17 for transmission of mechanical power from the main driving shaft 13 to the shaft 23 of the thread feed means 2. The shaft 23 extends through the right bracket 22 to have an end thereof project out of the right bracket 22 with a first gear 233 and a cam 234 rigidly mounted thereon. Opposite to the first gear 233, a control disk 232 is mounted on the shaft 23 on the other side of the right bracket 22.

The thread feed means 2 comprises a thread winding device 24, a thread pinching device 25, a thread pulling device 26 and a thread shifting device 27 which will be described hereinafter.

As shown in FIGS. 2 and 3, the thread winding device 24 is mounted on a support frame 201. The support frame 201 has supported thereon a spring-biased resilient guide roller 242 which provides a suitable gripping force to a lower thread 6 to guide the lower thread 6 upwards. The support frame 201 also has guide rollers 243 and 244 thereon for escorting the lower thread 6 from the thread pinching device 25 to the thread pulling device 26.

Figure 5:
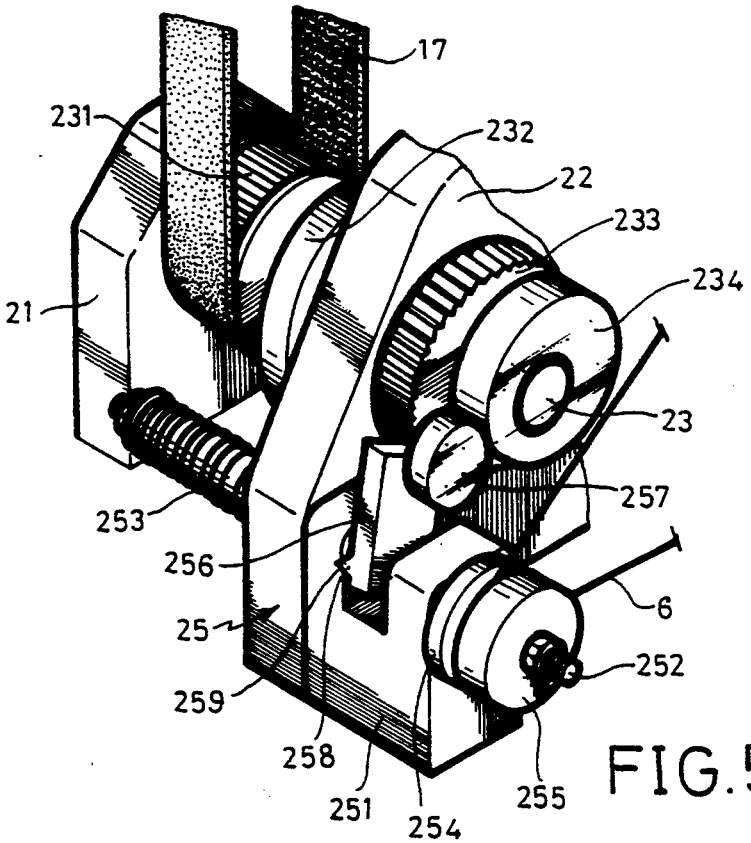
FIG. 5 is a perspective view showing the thread pinching device of the thread feed device wherein the movable pinching roller is abutting against the stationary pinching roller to pinch the lower thread therebetween.
Figure 6:
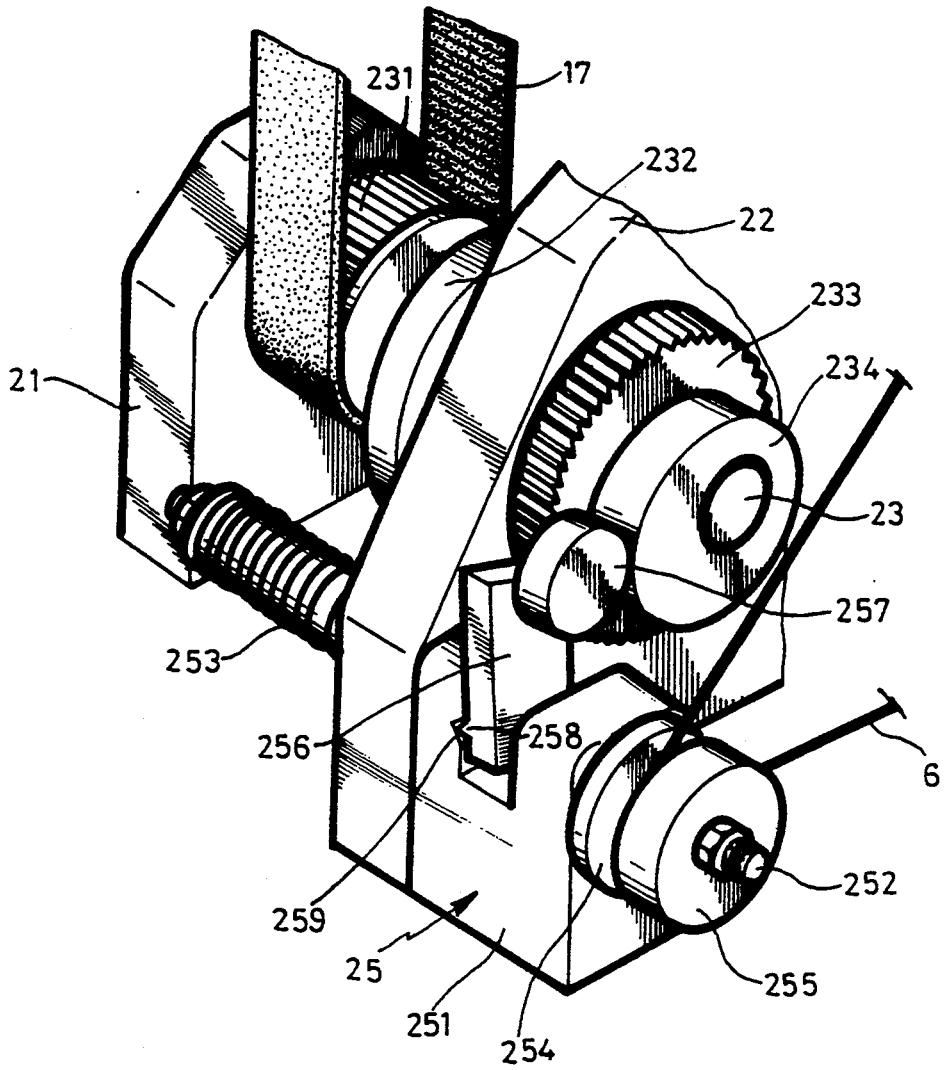
FIG. 6 is also a perspective view showing the thread pinching device of the thread feed means wherein the movable pinching roller disengages from the stationary pinching roller to free the lower thread pinched therebetween.

As shown in FIGS. 5 and 6, the thread pinching device 25 comprises a seat 251 juxtaposing the right bracket 22 with an axle 252 extending through the seat 251 and the right bracket 22 in such a manner to be movable relative thereto. A spring 253 is disposed between the right bracket 22 and an end flange of the axle 252 to bias the axle 252. On the axle 252, a stationary pinching wheel 254 and a movable pinching wheel 255 are mounted so that the movable pinching wheel 254 is movable with the axle 252 while the stationary pinching wheel 254 is axially fixed with the seat 251 when the axle 252 is moving. The lower thread 6 is pinched between the two wheels 254 and 255 by the contact engagement between the wheels 254 and 255 by the biasing force of the spring 253.

The seat 251 has a rocking block 256 mounted on the axle 252 with a follower 257 fixed thereon to be in contact engagement with the cam 234. The rocking block 256 has a camming projection 258 formed thereon to be acted upon by a camming notch 259 provided on the seat 251 so that when the shaft 23 rotates the cam 234 to drive the follower 257 and thus back-and-forth rock the rocking block 256, the rocking block 256 together with the axle 252 is axially moved relative to the seat 251 and the right bracket 22 by the camming action between the camming projection 258 and the camming notch 259 to move the movable pinching wheel 255 away from the stationary pinching wheel 254 against the biasing force of the spring 253 and thus free the lower thread 6 from being pinched by the wheels 254 and 255. The biasing spring 253 provides a restoring force to the camming projection 258 to move it into the camming notch 259 when it passes the camming notch 259 and the lower thread 6 is pinched by the wheels 254 and 255 under this situation. This provides the lower thread 6 with a cyclic loose and tight condition.

Figure 4:
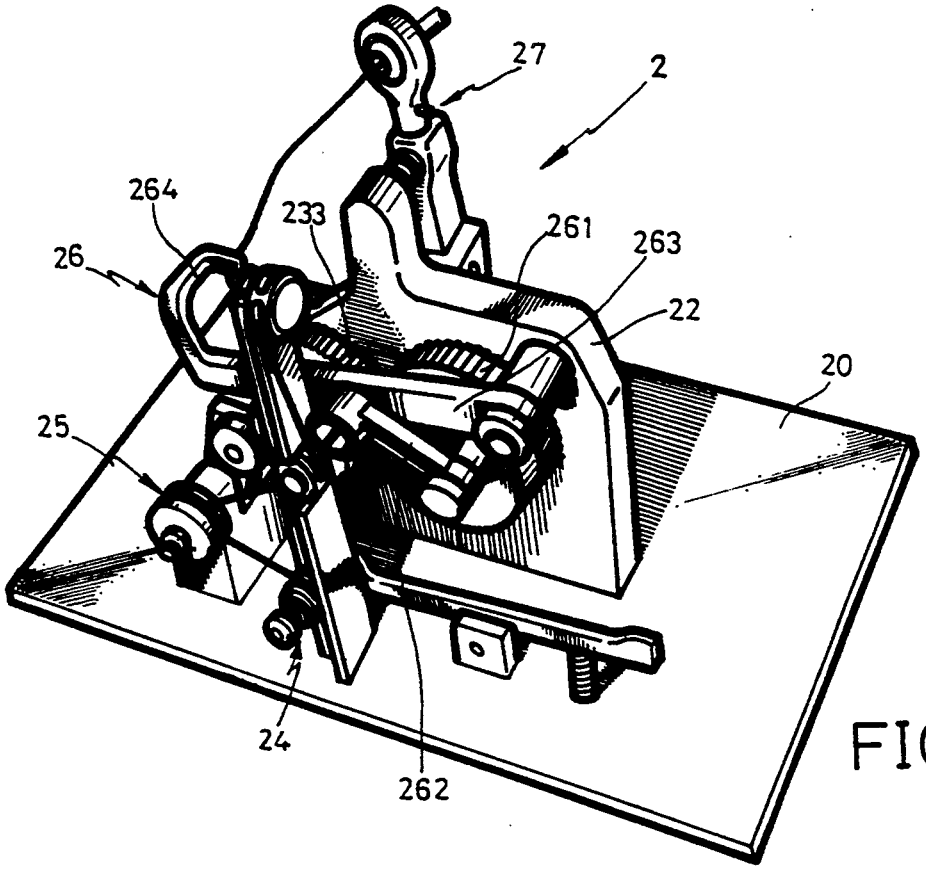
FIG. 4 is a perspective view also showing the thread feed means from a different angle.
Figure 7:
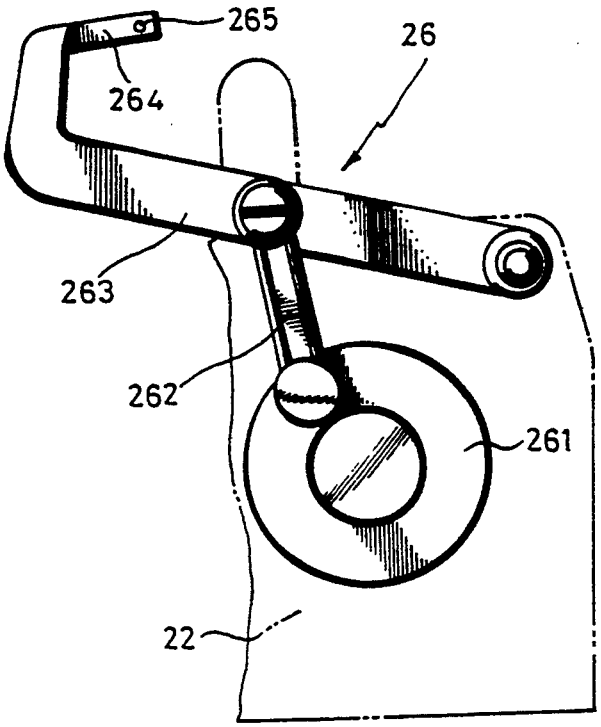
FIG. 7 is a side elevational view showing the thread pulling device of the thread feed means.
Figure 8:
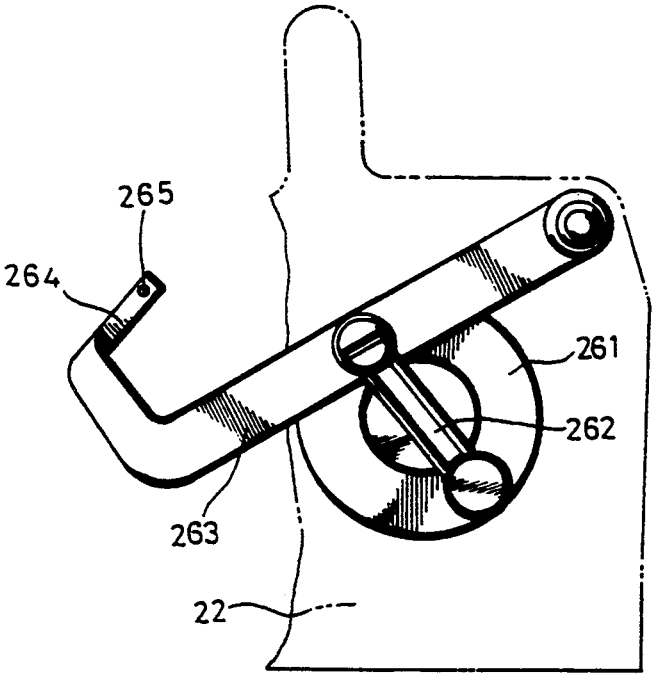
FIG. 8 is a side elevational view also showing the thread pulling device of the thread feed means in a different operation position.

As shown in FIGS. 4, 7 and 8, the thread pulling device 26 comprises a second gear 261 mounted on the right bracket 22 and mating the first gear 233 for driving the thread pulling device 26. The second gear 261 has rotatably mounted thereon in an eccentric manner an end of a link 262 which is pivoted at an opposite end thereof to a middle section of a pulling beam 263 having a rear end thereon pivoted to the right bracket 22 and a front end backward bent to form a hook-like end 264 with an eyelet 265 formed thereon. The rotation of the second gear 261 drives the link 262 to rotate and orbit about the central axis thereof and this rocks the pulling arm 263 up and down about the pivot connection thereof to the right bracket 22.

The up-and-down rocking movement of the pulling arm 263, when cooperating with the cyclic loose and tight condition of the lower thread 6 provided by the thread pinching device 25, controls the forward feeding and backward withdrawing of the lower thread 6.

Figure 9:
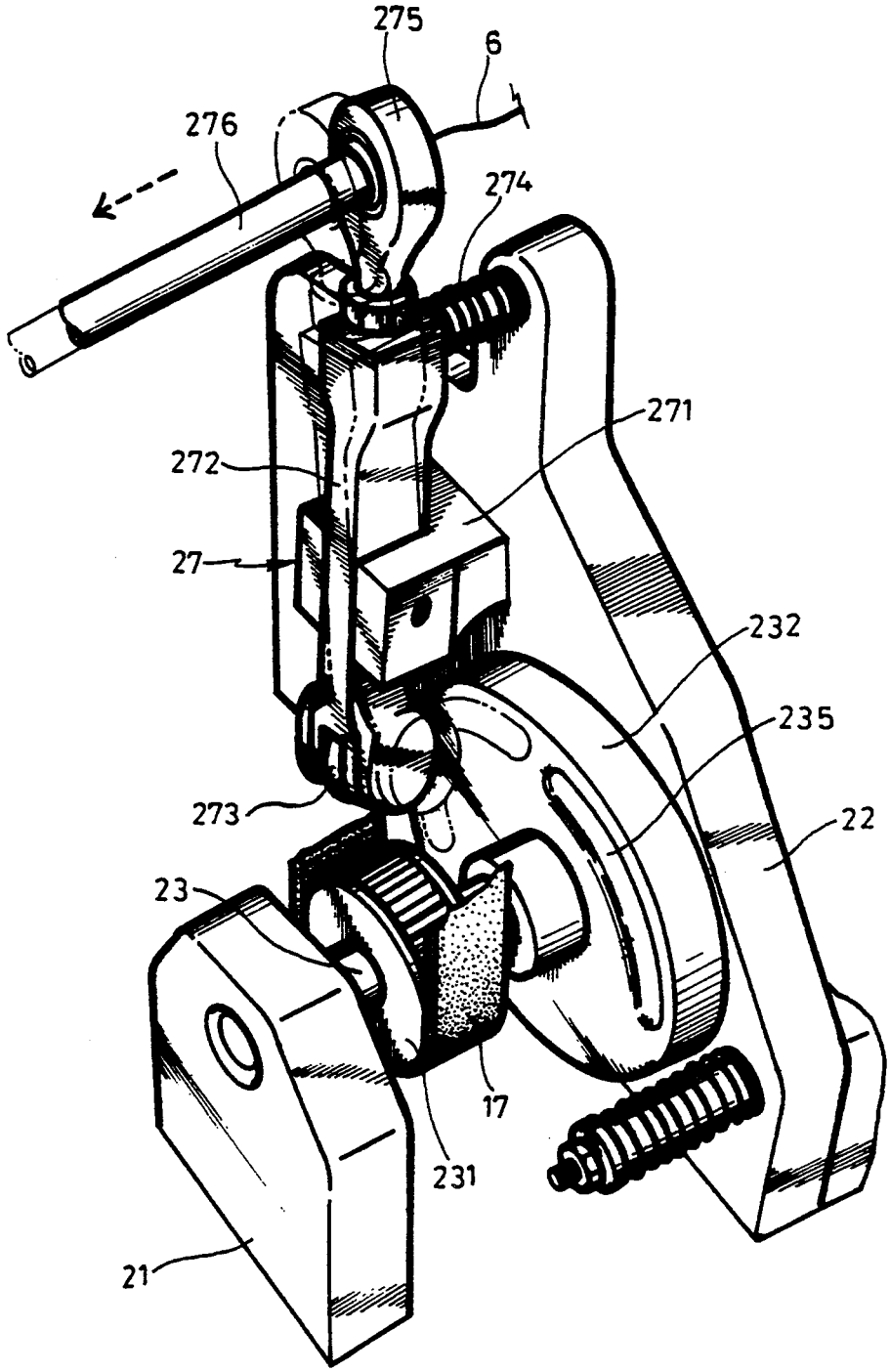
FIG. 9 is a perspective view showing the thread shifting device of the thread feed means.
Figure 10:
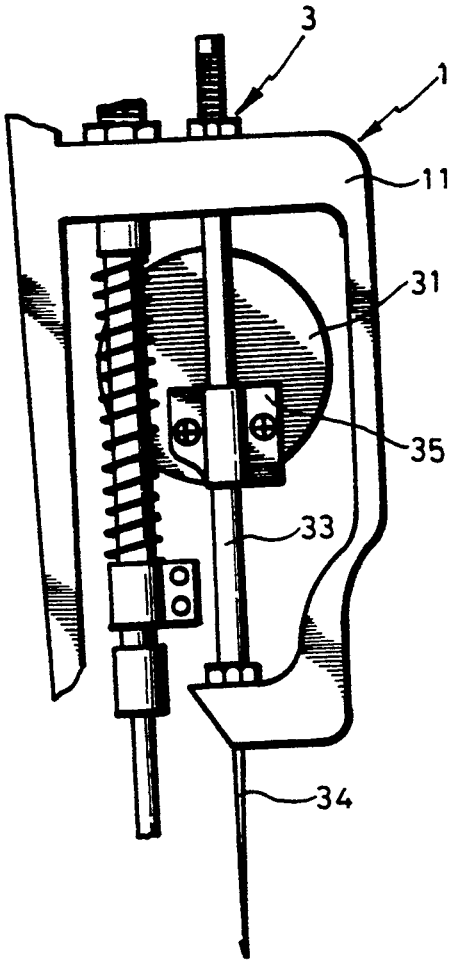
FIG. 10 is a side elevational view showing the stitching means of the shoe sewing machine of the present invention.
Figure 11:
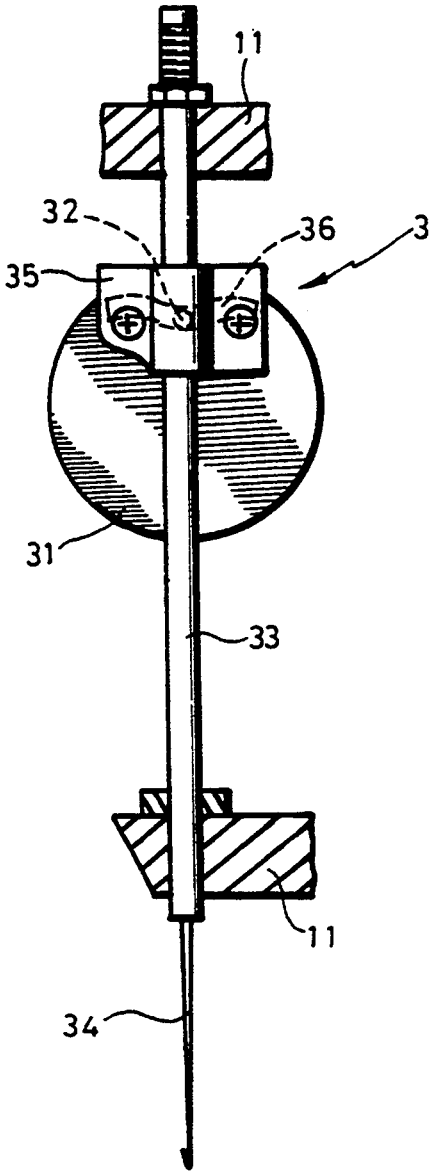
FIG. 11 is also a side elevational view, in a larger scale, showing the stitching means.

As shown in FIGS. 2, 3 and 9, the thread shifting device 27 comprises a frame support 271 secured on the right bracket 22 with a rocking bar 272 pivoted thereon to be rockable forward and backward about the pivot. The rocking bar 272 is biased by a spring 274 disposed between an upper end thereof and the right bracket 22 and has a follower 273 which is rotatably mounted to a lower end thereof in contact engagement with the control disk 232. The control disk 232 comprises at least an arc recess 235 extending in a circumferential direction of the control disk 232. The movement into and out of the recess 235 of the follower 273 rocks the rocking bar 272 forward and backward.

The rocking bar 272 further comprises a connector 275 mounted on the spring-biased end thereof to hold a tubular member 276 thereon. The lower thread 6 that is guided by the roller 243 extends through the eyelet 265 of the pulling beam 263 to enter the tubular member 276 for advancing to the rocking arm 5.

The to-and-fro rocking motion of the rocking bar 272 controls the rocking arm 5 so as to have the lower thread 6 form a loop at a needle slot 55 of the rocking arm 5 to allow a hook needle 34 to penetrate therethrough and thus catch the lower thread 6 to pull it upward.

As shown in FIGS. 1, 2 and 3, the rocking arm 5 comprises a support 52 for pivotally supporting the rocking arm 5 to the base 12 of the housing 1 and a head 54 opposite to the support 52. The tubular member 275 extends into the support 52 and in communication with a passage 53 extending through the rocking arm 5 from the support 52 to the head 54. The passage 53 is also in communication with the needle slot 55 that is formed on the head 54. An elongated strip 56 connecting at one end thereof to the end portion of the tubular member that extends into the rocking arm 5 to be driven thereby extends following the passage 53 and has a hollow shaft 561 mounted on the opposite end thereof. The hollow shaft 561 which is connected between the passage 53 and the needle slot 55 allows the lower thread 6 to extend from the passage 53 to the needle slot 55.

To make the lower thread 6 completely follow the passage 53, thread escorting rollers 57 are provided within the passage 53 at suitable locations.

As shown in FIGS. 1, 3, 10 and 11, the stitching means 3 is driven by the friction disk 31 which is in turn driven by the main driving shaft 13. The stitching means 3 comprises a needle bar 33 disposed inside the bridge 11 with a hook needle 34 attached to a lower end thereof to extend out of the under side of the bridge 11 to be movable into the needle slot 55 of the rocking arm 5. The needle bar 33 is slidably mounted to the friction disk 31 by a retainer plate 35. The retainer plate 35 has a wavy slot 36 formed thereon for receiving therein an eccentric pin 32 extending from the friction disk 31 so that when the friction disk 31 is driven by the main driving shaft 13 to rotate, the eccentric pin 32 which is received within the wavy slot 36 of the retainer plate 35 moves the needle bar 33 and the hook needle 34 up and down with a non-uniform speed. The hook needle 34, as mentioned previously, is movable into the needle slot 55 of the rocking arm 5 to hook and pull out the lower thread 6 that extends through the passage 53 to the needle slot 55.

Figure 12:
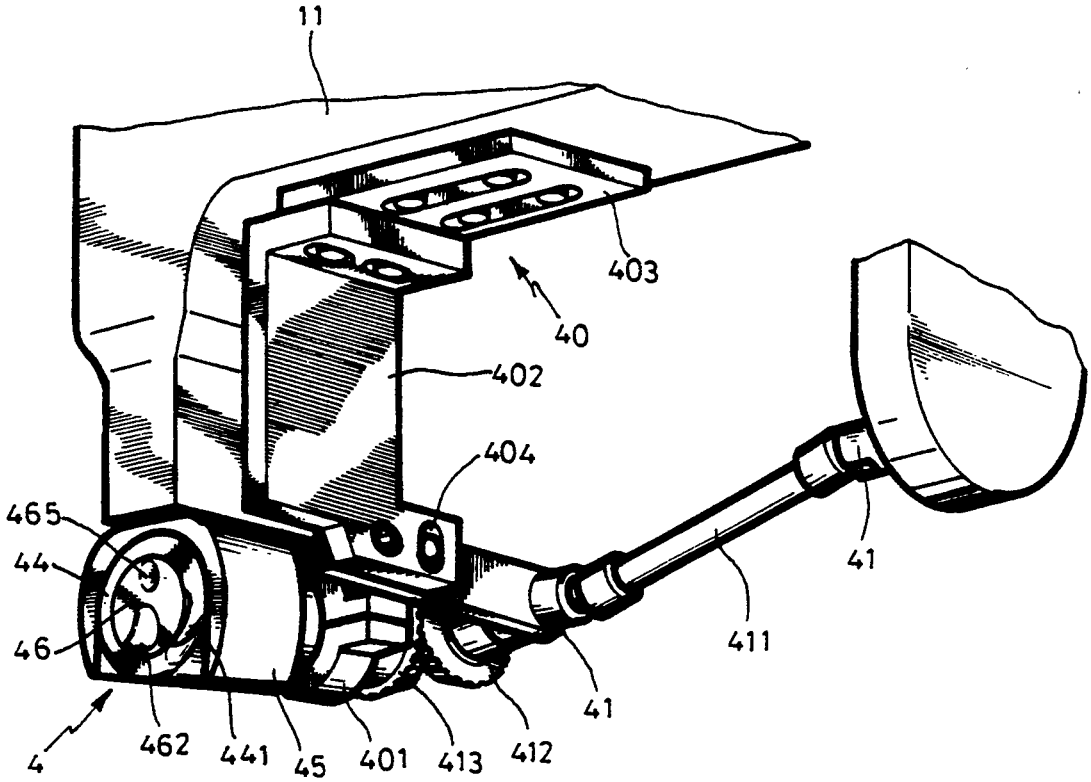
FIG. 12 is a perspective view showing the thread hooking means of the shoe sewing machine of the present invention.
Figure 13:
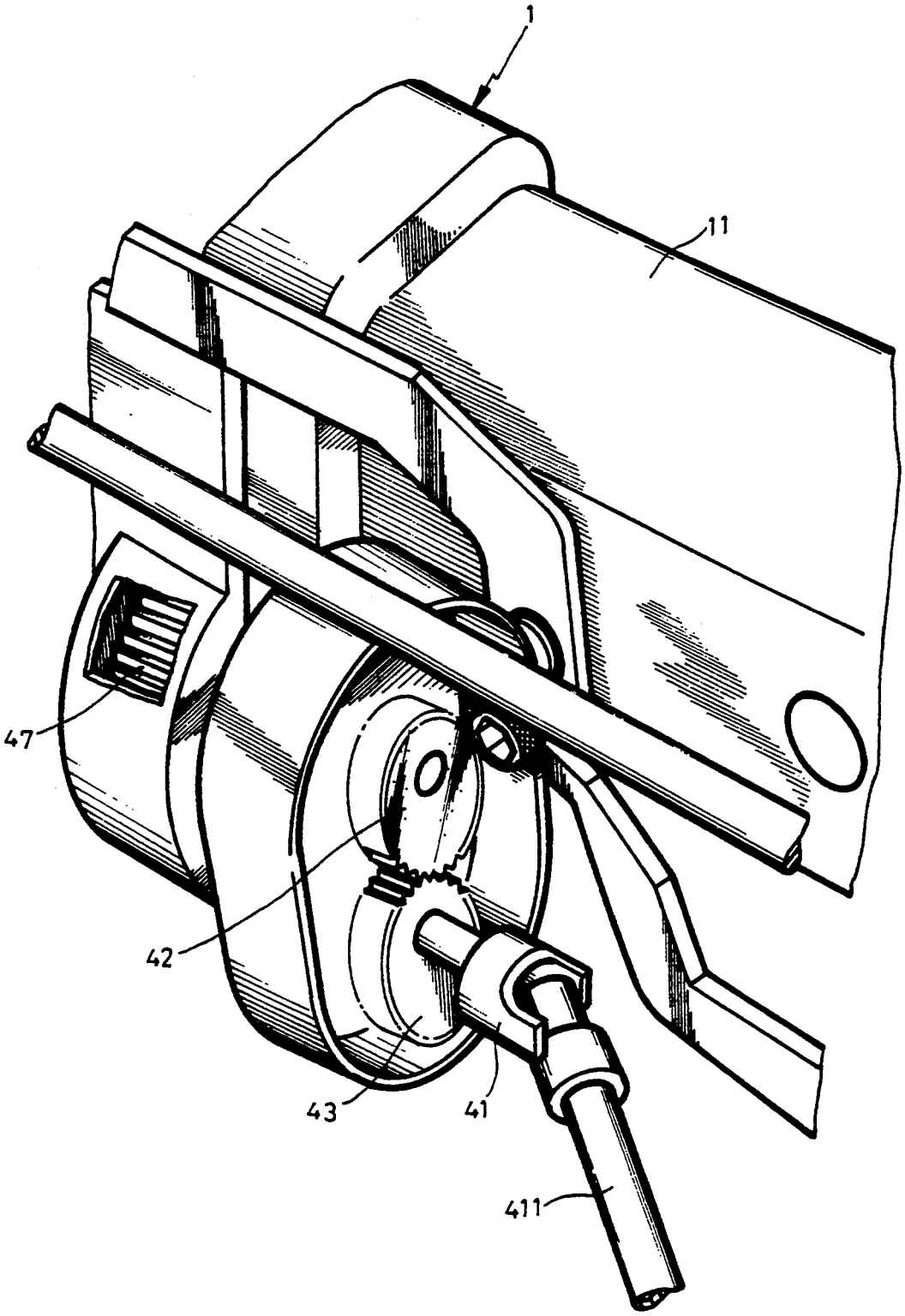
FIG. 13 is a perspective view showing the transmission of the thread hooking means.

As shown in FIGS. 1, 12 and 13, the thread hooking means 4 which is disposed on the under side of the bridge 11 of the housing 1 is driven by the main driving shaft 13 via a gear 47 disposed on the rear side of the housing 1, a pair of mated elliptic toothed wheels, the first elliptic toothed wheel 42 and the second elliptic toothed wheel 43, in mechanical connection with the gear 47 and two universal joints 41 and the linking bar 411 therebetween. The elliptic toothed wheel pair 42 and 43 forms an eccentric engagement therebetween which results in a non-uniform speed transmission. The non-uniform rotation is transmitted by the universal joints 41 and the linking bar 411. One of the universal joints 41 is connected to a direction change gear train constituted by a pair of mated bevel gears 412 and 413 for transmitting the non-uniform speed rotation to a rotating shuttle 44 which is connected to the bevel gear pair 412 and 413 and disposed under the bridge 11 to make the rotating shuttle 44 rotating in a non-uniform speed.

Figure 14:
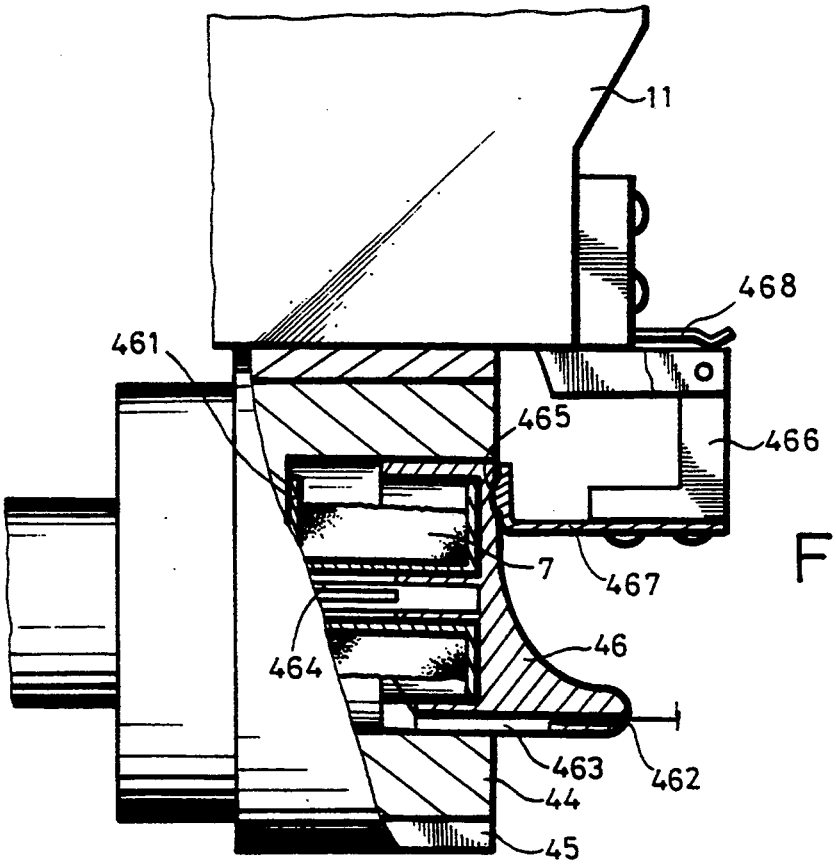
FIG. 14 is a side elevational view, partly sectioned, showing a portion of the thread hooking means.

The shuttle 44 which is disposed within a casing 45 under the bridge 11 has a bend 441 formed thereon. As shown in FIG. 14, the shuttle 44 has received within a central recess thereof a spool enclosure 46, which has enclosed therein a spool 461. The spool enclosure 46 has formed on the front side thereof a thread outlet 462 which extends inward to form a thread guiding groove 463 inside the spool enclosure 46. The spool enclosure 46 comprises an elongated central axle 464 which has lengthwise slots formed thereon to be received within a central bore of the spool 461. An upper thread 7 unwound from the spool 461 extends out of the spool enclosure 46 through the thread guiding groove 463 and the thread outlet 462.

The spool 461 and spool enclosure 46 are retained within the central recess of the shuttle 44 by having a dent 465 thereof engaged by a resilient plate 467 which is fixed on a releasing pivoting seat 466 and biased by resilient holding plate 468 mounted on the bridge 11 so that by releasing and rotating the pivoting seat 466, the resilient plate 467 disengages from the dent 465 to release the spool enclosure 46 and thus the spool 461 can be changed for a new upper thread 7.

As shown in FIG. 12, the thread hooking means 4 comprises an adjustment device 40 which comprises a swivel 401 connected to the rear side of the shuttle 44 for adjusting the angular position of the shuttle 44 relative to the casing 45, a cross seat 403 mounted on the under side of the bridge 11 with elongated slots formed thereon to receive therein pins in a slidable manner for slidably adjusting the thread hooking means 4 relative to the bridge 11, and an upright-seat 402 disposed under the bridge 11 and connected to the cross seat 403. The upright seat 402 has slots formed on an upper end thereof and an arc slot 404 formed on a lower end thereof for receiving therein pins in a slidable manner to adjust the relative position of the thread hooking means 4 with respect to the bridge 11 and the angular position of the bend 441 of the shuttle 44 to accommodate the thickness and rigidness of the object to be sewn, such as that indicated by reference numeral 8 in FIG. 15.

Figure 15:
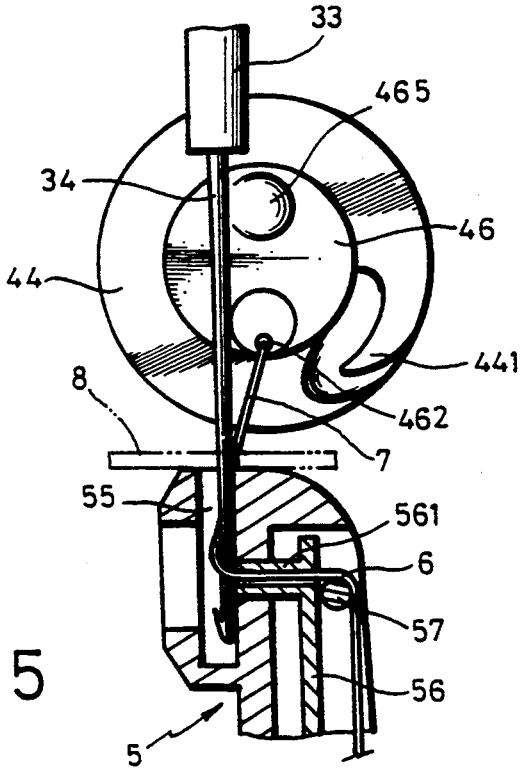
FIG. 15 is a side elevational view showing the relationship between the hook needle and the shuttle when practicing sewing.
Figure 16:
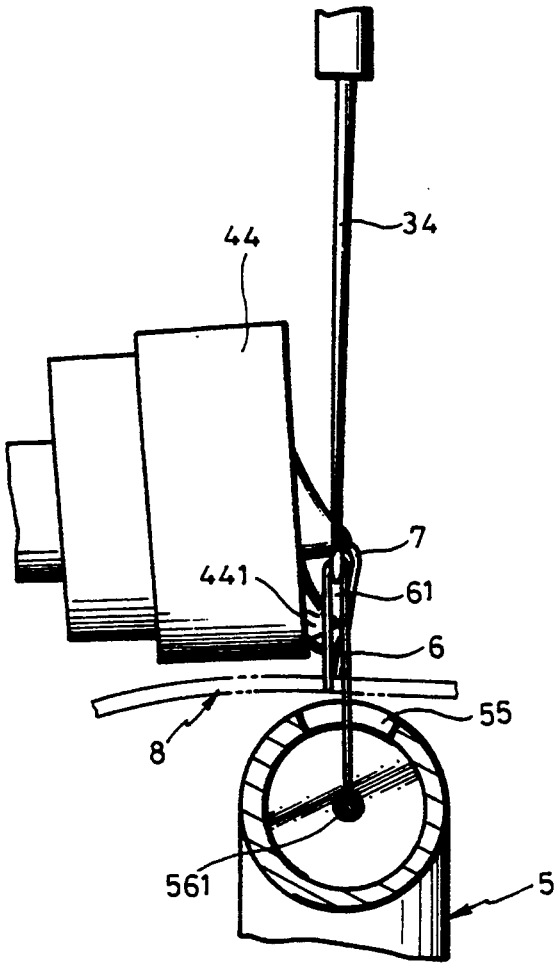
FIG. 16 is a side elevational view from a different angle from that of FIG. 15, showing the relationship between the hook needle and the shuttle when practicing sewing.
Figure 17:
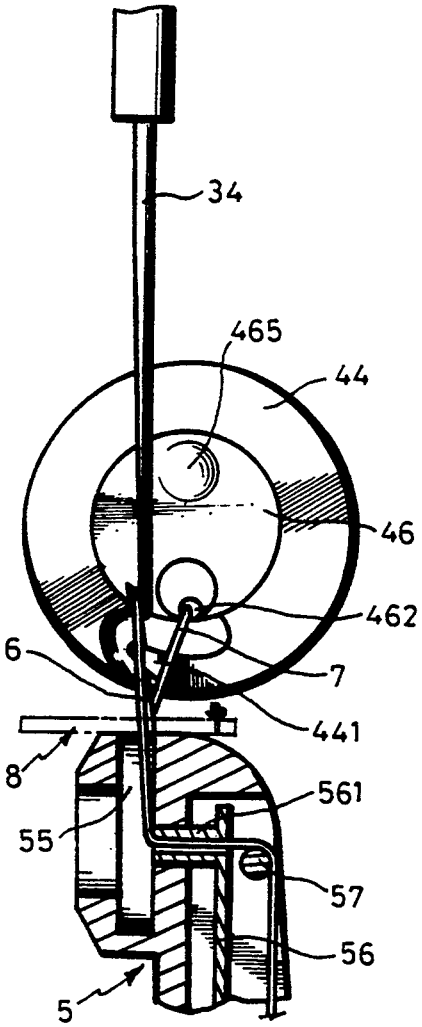
FIGS. 17–19 are side elevational views showing the subsequent operational relationship between the hook needle and the shuttle after that of FIG. 15.

As shown in FIG. 15, wherein an object 8 to be sewn with the lower thread 6 supplied by the thread feed means 2 and the upper thread 7 supplied by the thread hooking means 4 is shown, in operation, when the hook needle 34 enters the needle slot 55 of the rocking arm 5, the elongated strip 56 disposed inside the rocking arm 5 is moved by the thread shifting device 27 to pull the lower thread 6 backward so as to make the lower thread 6 attach to the hook needle 34. Thereafter, as shown in FIGS. 16 and 17, the hook needle 34 catches and pulls the lower thread 6 upward to form a loop 61 on the lower thread 6 which allows the bend 441 of the shuttle 44 that is just rotated to such a location to enter.

Figure 18:
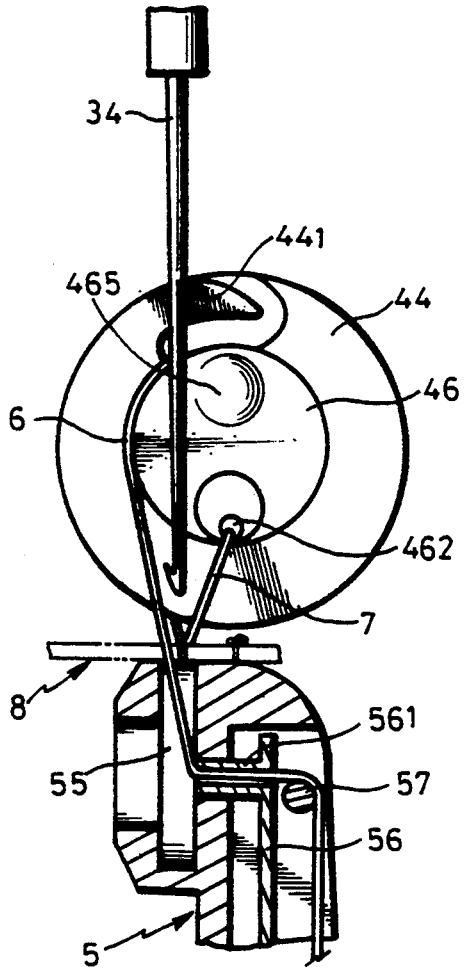

As shown in FIG. 18, the lower thread 6 disengages from the hook needle 34 and moves to a desired position by being pulled by the rotation of the bend 441 of the shuttle 44. After that, the further rotation of the shuttle 44 allows the lower thread 6 to escape from being held by the bend 441, as shown in FIG. 19, to entangle with the upper thread 7 supplied from the spool 461 through thread outlet 462 to form a stitch on the object 8.

The hook needle 34 is then lowered down to penetrate the object 8 for bringing the lower thread 6 upward again to repeat the just-described sewing procedure. This sewing procedure is repeated to have the lower thread 6 and the upper thread 7 form continuous stitching on the object 8.

With such an arrangement described herein, in the sewing operation, the bend 441 of the shuttle 44 is rotated in a non-uniform speed by the elliptic gear pair 42 and 43 to allow the bend 441 to enter the thread loop 61 of the lower thread 6 fast. Further, by the cooperation between the pin 32 of the friction disk 31 of the stitching means 3 and the wavy slot 36 of the retainer plate 35 which mount the needle bar 33 to the friction disk 31, a non-uniform speed motion is applied to the hook needle 34 so that when the hook needle 34 enters the needle slot 55 of the rocking arm 5, it moves very slowly and when the lower thread 6 is pulled backward by the thread shifting device 27 to attach to the hook needle 34, the hook needle 34 speeds up to moves the lower thread 6 upward out of the needle slot 55 very quickly. All these, cooperating with the motion of the elongated strip 56 inside the rocking arm 5 driven by the thread shifting device 27 and the thread feed action of the thread feed means 2, provides the lower thread 6 with a repeated forward-and-backward, tight-and-loose and fast-and-slow control to allow the lower thread 6 and the upper thread 7 to efficiently form stitching on the object 8.

Figure 19:
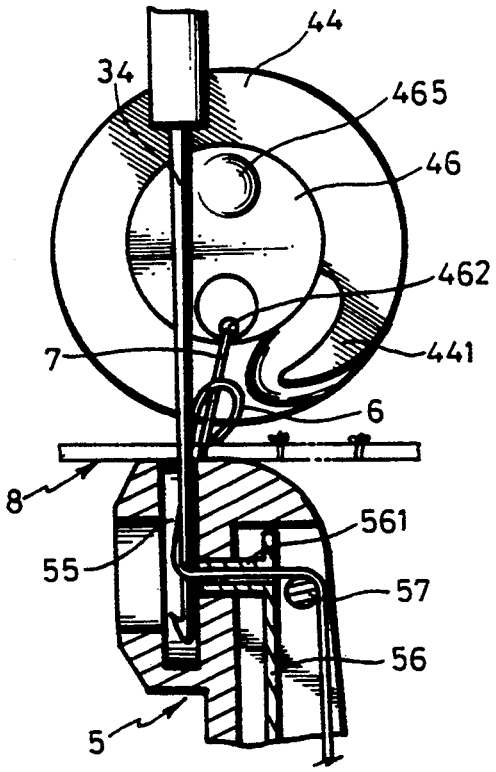
Figure 20:
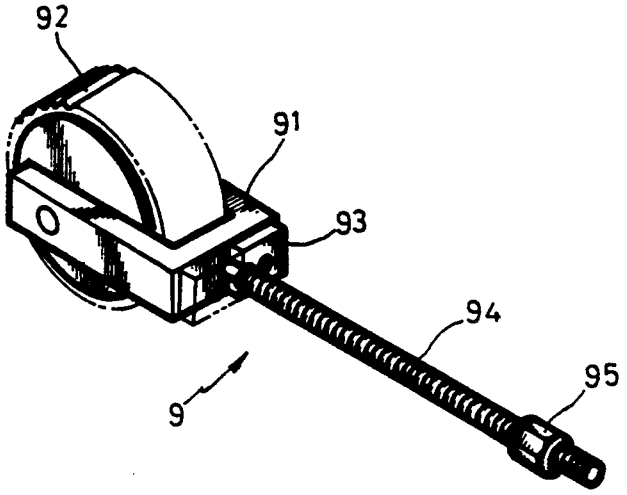
FIG. 20 is a perspective view showing the belt tension adjustment device used to adjust the tension of the belt of the main driving shaft of the shoe sewing machine of the present invention.
Figure 21:
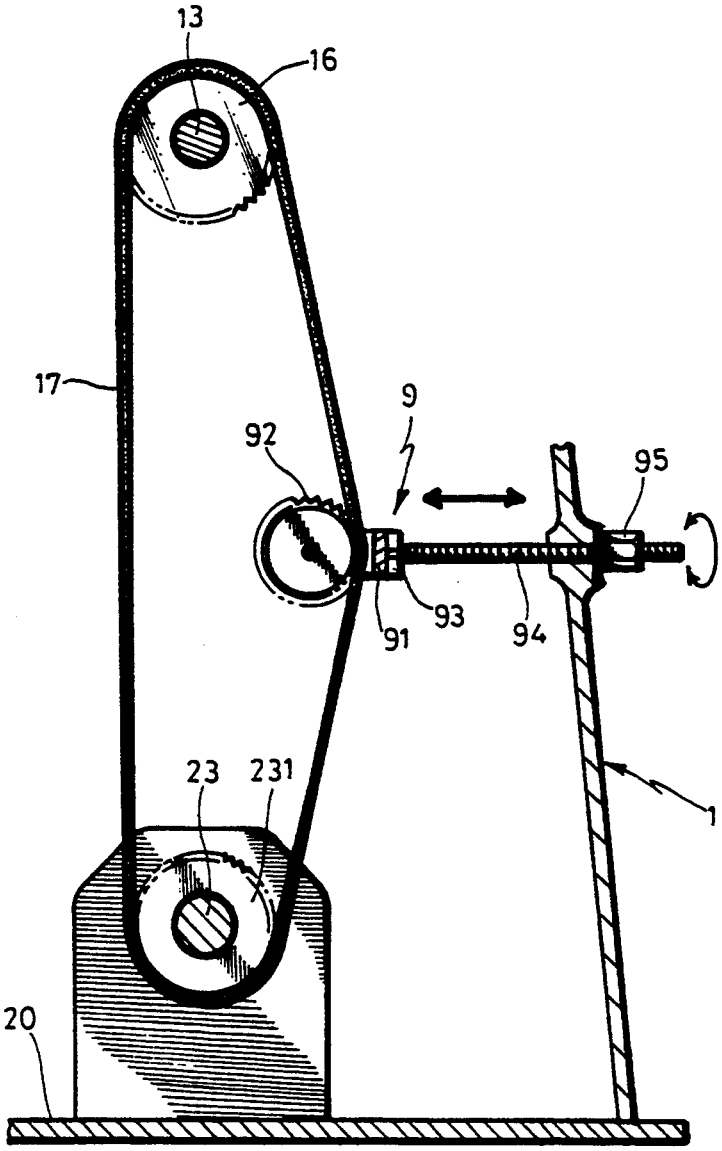
FIG. 21 is a cross-sectional view showing the adjustment of the belt tension by the belt tension adjustment device.

As shown in FIGS. 19 and 20, the shoe sewing machine of the present invention further has a belt tension adjustment device 9 which comprises an adjusting wheel 92 in contact engagement with the belt 17. The adjusting wheel 92 is rotatably supported by a support frame 91 which has rotatably mounted thereon by a pair securing blocks 93 an end of a threaded rod 94 which has an opposite end extending out of the housing 1 to be threadedly engageable by a nut member 95 substantially abutting against the housing 1 so that by tightening or rotating the nut member 95, the adjusting wheel 92 is moved to stretch the belt 17 and thus adjusting the tension of the belt 17.

It is apparent that although the invention has been described in connection with the preferred embodiment, it is contemplated that those skilled in the art may make changes to certain features of the preferred embodiment without departing from the spirit and scope of the invention as defined in the appended claims.

What is claimed is:

1. A shoe sewing machine, comprising:

a housing having a base on which a hollow bridge is mounted, said bridge having disposed therein a main driving shaft with a pulley engaging a belt secured thereto;

thread feed means which is disposed within the base of said housing, comprising a thread winding device, a thread pinching device, a thread pulling device and a thread shifting device, said thread feed means comprising a right bracket and a left bracket spacedly mounted to a base plate on which said housing is mounted with a shaft rotatably mounted therebetween, a gear being mounted to said shaft and in engagement with the belt of said main driving shaft to be driven thereby, a control disk mounted to the shaft juxtaposing the right bracket within the space between the left and right brackets, a first gear and a cam being mounted to the shaft adjacent to the right bracket, opposite to the control disk, the control disk having formed thereon at least an arc recess extending in a circumferential direction threreof;

stitching means comprising a friction disk secured to one end of the main driving shaft with a pin mounted on the friction disk in an eccentric manner, a needle bar substantially disposed within the bridge of the housing and a retainer plate slidably securing the needle bar to the friction disk, said retainer plate having formed thereon a wavy slot for receiving therein the eccentric pin to guide the needle bar so that it moves up and down with a non-uniform speed by the rotation of the friction disk with the main driving shaft;

thread hooking means which is disposed on an under side of the bridge, a transmission providing a non-uniform speed motion to said thread hooking means, said thread hooking means comprising a rotating shuttle disposed in a casing located under said bridge, a spool disposed within a spool enclosure received within a recess of the shuttle, a releasing pivoting seat having attached thereto a resilient plate for engaging and retaining the spool within the shuttle and a resilient holding plate fixed on the bridge to bias the pivoting releasing seat to retain the spool in position, and an adjustment device for adjusting a relative position of the thread hooking means with respect to the bridge of the housing;

a rocking arm extending from the base of the housing, comprising a support for pivotally supporting the rocking arm to the base of the housing and a head opposite to the support, a passage defined within the rocking arm and extending from the support to the head thereof, an elongated strip disposed within the passage and having a hollow shaft connected to an end thereof and extending into a needle slot formed on the head, the elongated strip having an opposite end connected to the thread shifting device, a number of thread escorting rollers being disposed within the passage for guiding a lower thread.

2. A shoe sewing machine as claimed in claim 1, wherein said thread feed means comprises a support frame fixed on the base plate and wherein said thread winding device has supported on the support frame a spring-biased resilient guide roller which provides a suitable gripping force to the lower thread and a number of guide rollers for escorting the lower thread from said thread pinching device to said thread pulling device.

3. A shoe sewing machine as claimed in claim 1, wherein said thread pinching device comprises a seat juxtaposing the right bracket with an axle extending through the seat and the right bracket in such a manner to be movable relative thereto, a spring being disposed between the right bracket and an end flange of the axle to bias the axle, a stationary pinching wheel and a movable pinching wheel being mounted to the axle to be in releasable contact engagement with each other by the biasing spring to pinch the lower thread, the seat having a rocking block pivotally mounted thereon on the axle with a follower fixed thereon to be in contact engagement with the cam mounted to the main driving shaft, the rocking block comprising a camming projection formed thereon to be acted upon by a camming notch provided on the seat so as to move the axle relative to the seat against the spring to disengage the pinching rollers by the camming action therebetween.

4. A shoe sewing machine as claimed in claim 1, wherein said thread pulling device comprises a second gear mounted on the right bracket and mating the first gear, the second gear having rotatably mounted thereon in an eccentric manner an end of a link which is pivoted at an opposite end thereof to a middle section of a pulling beam having a rear end thereon pivoted to the right bracket and a front end backward bent to form a hook-like end with an eyelet formed thereon.

5. A shoe sewing machine as claimed in claim 1, wherein said thread shifting device comprises a support frame secured on the right bracket with a rocking bar pivoted thereon to be rockable about the pivot, the rocking bar being biased by a spring disposed between an upper end thereof and the right bracket and having a follower which is rotatably mounted to a lower end thereof in contact engagement with the control disk, the rocking bar further comprising a connector mounted on the spring-biased end thereof to hold thereon a tubular member which is connected to the elongated strip disposed within the passage of the rocking arm.

6. A shoe sewing machine as claimed in claim 1, wherein the transmission connected to said thread hooking device comprises a gear driven by the main driving shaft, a first elliptic toothed wheel in mechanical connection with and driven by said gear, a second elliptic toothed wheel mating said first elliptic gear, a direction change gear train constituted by a pair of mated bevel gears which are in connection with the rotating shuttle and a set of universal joints and a linking member connected between the elliptic gears and the bevel gears to apply a non-uniform speed motion from the elliptic gears to the rotating shuttle.

7. A shoe sewing machine as claimed in claim 1, wherein said spool enclosure comprises a thread outlet formed on a front side thereof with a thread guiding groove extending inward therefrom for guiding an upper thread wound on the spool received within the spool enclosure with a central bore thereof fit over an elongated central axle of the spool enclosure to penetrate through the outlet.

8. A shoe sewing machine as claimed in claim 1, wherein the adjustment device of said thread hooking means comprises a swivel connected to the shuttle for adjusting angular position of the shuttle relative to the casing, a cross seat mounted on an under side of the bridge with elongated slots formed thereon to receive therein pins in a slidable manner for slidably adjusting the thread hooking means relative to the bridge, and an upright seat disposed under the bridge and connected to the cross seat, the upright seat having slots formed on an upper end thereof and an arc slot formed on a lower end thereof for receiving therein pins in a slidable manner to respectively adjust a position of the thread hooking means relative to the bridge and the angular position of the shuttle.

9. A shoe sewing machine as claimed in claim 1, wherein the belt of the main driving shaft comprises a belt tension adjustment device which comprises an adjusting wheel in contact engagement with the belt, the adjusting wheel being rotatably supported by a support frame which has rotatably mounted thereon by a pair of securing blocks an end of a threaded rod which has an opposite end extending out of the housing to be threadedly engageable by a nut member substantially abutting against the housing so that by tightening and rotating the nut member, the adjusting wheel is moved to stretch the belt for adjusting the tension of the belt.

* * * * *